US005668567A

United States Patent [19]

Iwama

[11] Patent Number: 5,668,567

[45] Date of Patent: Sep. 16, 1997

[54] ELECTRO-OPTICAL DISPLAY DEVICE

[75] Inventor: Jun Iwama, Kanagawa, Japan

[73] Assignee: Sony Corporation, Tokyo, Japan

[21] Appl. No.: 560,406

[22] Filed: Nov. 17, 1995

[51] Int. Cl.[6] ..... G09G 3/18

[52] U.S. Cl. ..... 345/60; 345/87; 345/94

[58] Field of Search ..... 345/60, 87, 94, 345/95, 96, 208, 209

[56] References Cited

U.S. PATENT DOCUMENTS

| | | | |
|---|---|---|---|
| 4,896,149 | 1/1990 | Buzak et al. | 340/794 |
| 4,945,352 | 7/1990 | Ejiri | 340/805 |
| 5,077,553 | 12/1991 | Buzak | 340/794 |
| 5,272,472 | 12/1993 | Buzak | 345/60 |
| 5,349,454 | 9/1994 | Iwama | 359/54 |
| 5,525,862 | 6/1996 | Miyazaki | 313/582 |

*Primary Examiner*—Richard Hjerpe
*Assistant Examiner*—Xu-Ming Wu
*Attorney, Agent, or Firm*—Hill, Steadman & Simpson

[57] ABSTRACT

An electro-optical display device in accordance with the present invention has a plurality of picture elements arranged in a matrix form, and each of the picture elements is composed of an electro-optical material layer and a switching element which is electrically connected to the material layer in a series form. A data voltage is written on the electro-optical material layer via the switching element for a writing period. A reference voltage is applied to the other end of a connection to which the data voltage is applied, and the reference voltage is inverted alternately together with the data voltage for each predetermined period, by which the electro-optical material layer is ac driven. The value of the data voltage is controlled to coincide approximately with that of the reference voltage for the periods other than the writing period.

9 Claims, 6 Drawing Sheets

ELECTRO-OPTICAL DISPLAY DEVICE

FIELD OF THE INVENTION

The present invention relates to an electro-optical display device, such as a plasma address display device and TFT liquid crystal display device, in which each picture element is composed of a series circuit of an electro-optical material layer and a switching element.

BACKGROUND OF THE INVENTION

A plasma addressed display device in which a plasma cell and an electro-optical display cell are laminated via a dielectric sheet has been proposed in U.S. Pat. No. 4,898,149 to Buzak (issue date: Jan. 23, 1990), U.S. Pat. No. 5,077,553 to Buzak (issue date: Dec. 31, 1991), and U.S. patent application Ser. No. 07/837,961 for an Electro Optical Device, filed by Shigeki Miyazaki on Feb. 20, 1992. The disclosure of the three above noted references are hereby incorporated herein.

FIG. 6 shows a circuit equivalent to a part of a plasma addressed display device. In FIG. 6, reference numeral 101 denotes an equivalent circuit for one picture element. CL denotes capacitance of a liquid crystal layer 7 for one picture element, CS and RS denote capacitance and resistance of a dielectric sheet 3, respectively, SW denotes a virtual switch (sampling switch) composed of a discharge channel 12, and CP and RP denote capacitance and resistance of a plasma section formed by barrier ribs 10 or the like, arranged in parallel with the virtual switch SW. In writing, the virtual switch SW is turned on by plasma discharge, and the voltage difference between data voltage DS and anode voltage VA is divided by the capacitance CS and CL and applied to the liquid crystal layer 7, by which the writing of data voltage DS is performed.

FIGS. 7A–7D show the relationship between data voltage DS (DS(1)–DS(m)), anode voltage VA, cathode voltage VK (VK(1)–VK(n−1)), etc. As shown in FIG. 7, the data voltage DS is supplied to data electrodes 5 (5(1)–5(m)) by a liquid crystal driver 21 for the writing period tw for each line, and the data electrodes 5 is at zero level for other periods. The data voltage DS is outputted from the liquid crystal driver 21 by being inverted for each one line and for each one field with (VH+VL)/2 being the center. Here, VH denotes positive dc voltage, and VL denotes negative dc voltage.

As shown in FIG. 7B, the anode voltage VA, outputted by an anode invert circuit anode 24, is outputted by being inverted for each one line and for each one field with (VH+VL)/2 being the center. Thereupon, the data voltage DS and the anode voltage VA are inverted alternately for one line and for one field, so that the liquid crystal layer 7 is ac driven.

The anode voltage VA changes alternately into VH and VL for one line as shown in FIG. 7B. The voltage difference between data voltage DS and anode voltage VA, and in turn the voltage applied to a series circuit of the liquid layer 7, dielectric sheet 3, and virtual switch SW changes as shown in FIG. 7D, so that there is a predetermined voltage difference even for the periods other than the writing period tw. As seen from the equivalent circuit in FIG. 6, the dielectric sheet 3 and the plasma section have finite resistances RS and RP, respectively, and an unnecessary voltage is applied to the liquid crystal layer 7 even for the periods other than the writing period tw, resulting in application of dc component to the liquid crystal layer 7. This application is undesirable because it may cause the deterioration in display characteristics such as the image retention of liquid crystal.

SUMMARY OF THE INVENTION

An object of the present invention is to provide an electro-optical display device in which the application of an unnecessary voltage to an electro-optical layer is prevented for the periods other than the writing period, by which the deterioration in display characteristics such as the image retention of the electro-optical material can be restricted and the long-term reliability can be enhanced.

In accordance with the present invention, there is provided an electro-optical display device comprising: a plurality of picture elements arranged in a matrix form, each of the picture elements being composed of an electro-optical material layer and a switching element which is electrically connected to the material layer in series means for providing a data voltage on the electro-optical material layer via the switching element for a writing period; means for applying a reference voltage to the other end of a connection to which the data voltage is applied, the reference voltage being inverted alternately together with the data voltage for each predetermined period, by which the electro-optical material layer is ac driven; and control means for making the value of the data voltage coincide approximately with that of the reference voltage for the periods other than the writing period.

By using such a configuration, since the value of the data voltage coincides approximately with that of the reference voltage for the periods other than the writing period, the application of an unnecessary voltage to the electro-optical material layer for the periods other than the writing period can be prevented, by which the image retention or the like of the electro-optical material can be restricted and the long-term reliability can be enhanced. Also, since the value of the data voltage coincides approximately with that of the reference voltage for the periods other than the writing period of, for example, each horizontal period, the effective value of the drive signal (voltage difference between the data voltage and the reference voltage) of each line decreases, so that the generation of crosstalk due to the drive signal of other lines can be restricted.

The switching element can be formed by a plasma switch or a thin film transistor. When the switching element is formed by a plasma switch, the value of the data voltage coincides approximately with that of the reference voltage even if finite resistance is present in parallel with the switching element formed by a plasma cell. Therefore, the application of an unnecessary voltage to the electro-optical material layer for the periods other than the writing period can be prevented. When the switching element is formed by a thin film transistor, the value of the data voltage coincides approximately with that of the reference voltage even if finite resistance is present in parallel with the switching element formed by a thin film transistor. Therefore, the application of an unnecessary voltage to the electro-optical material layer for the periods other than the writing period can be prevented.

A liquid crystal layer can be used as the electro-optical material layer. In this case, if the present invention is applied, since the value of the data voltage coincides approximately with that of the reference voltage, the application of an unnecessary voltage to the electro-optical material layer for the periods other than the writing period can be prevented, by which the deterioration in liquid crystal such as image retention can be restricted and the long-term reliability can be enhanced.

DETAILED DESCRIPTION OF THE PREFERRED EMBODIMENTS

Figure 3:
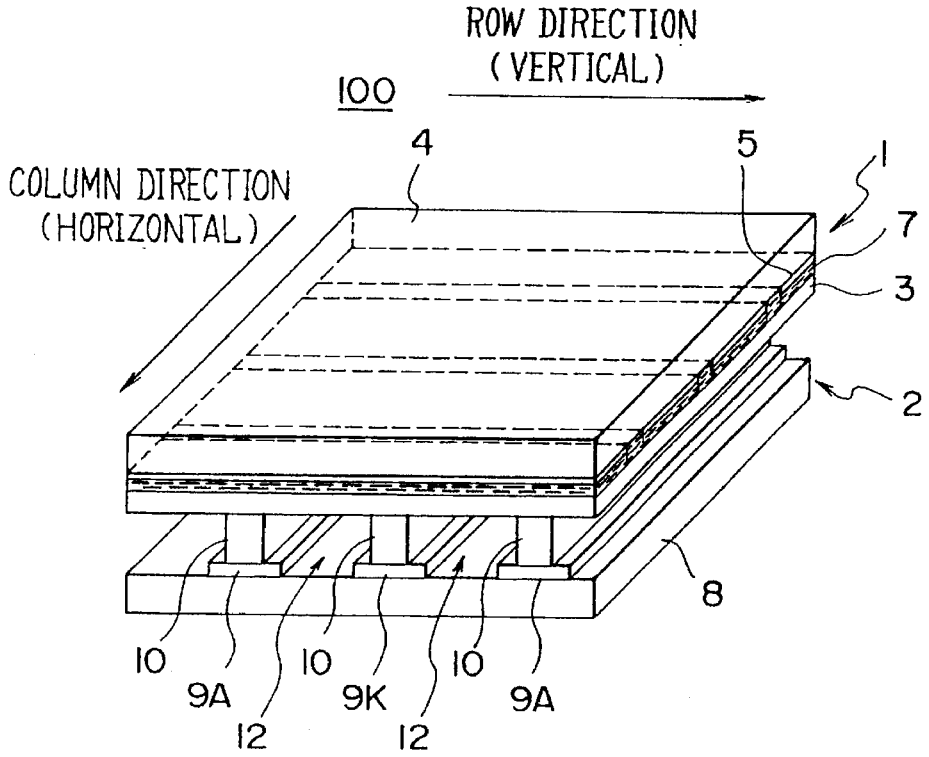
FIG. 3 is a perspective view showing a plasma address display device.
Figure 4:
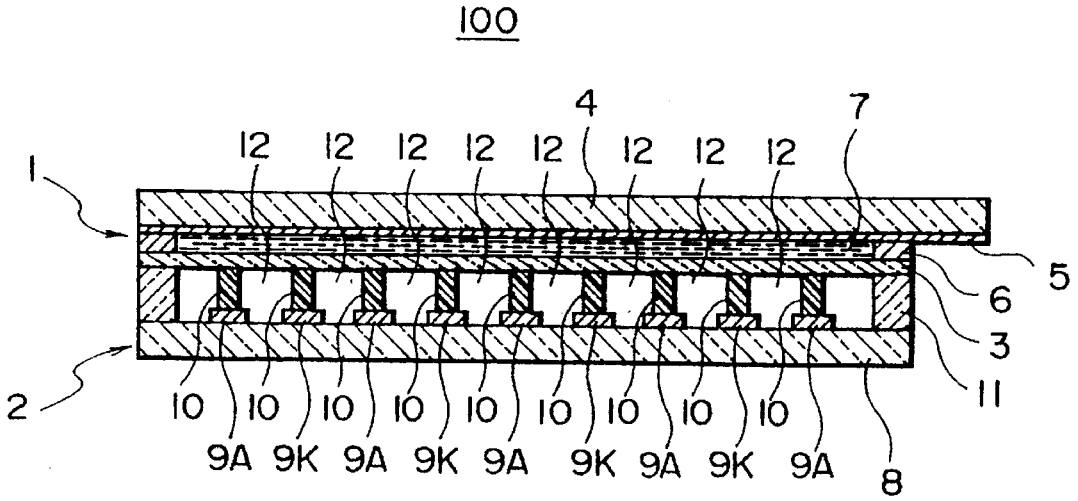
FIG. 4 is a sectional view showing a plasma address display device.

A preferred embodiment according to the present invention is described below with reference to the drawings. FIGS. 3 and 4 show the configuration of a plasma address display device 100 in accordance with the present invention.

The plasma address display device 100 has a flat panel construction in which an electro-optical display cell 1, a plasma cell 2, and a dielectric sheet 3 interposing between the two cells are laminated. The dielectric sheet 3 is formed by thin glass sheet or the like. It is necessary to make the dielectric sheet 3 as thin as possible to drive the display cell 1, so that the dielectric sheet 3 is formed so as to have a thickness of about 50 λm, for example.

The display cell 1 is formed by using a glass substrate (upper substrate) 4 on the upper side. On the main surface inside the upper substrate 4, a plurality of data electrodes 5, which are made of a transparent conductive material and extend in the row direction, are formed in parallel in the column direction with predetermined intervals being held. The upper substrate 4 is bonded to the dielectric sheet 3 with a predetermined gap being held by spacers 6. The gap between the upper substrate 4 and the dielectric sheet 3 is filled with liquid crystal as an electro-optical material to form a liquid crystal layer 7. The size of the gap between the upper substrate 4 and the dielectric sheet 3 is, for example, 4 to 10 λm, and kept uniform throughout the display surface. Any electro-optical material other than liquid crystal may be used.

On the other hand, the plasma cell 2 is formed by using a glass substrate (lower substrate) 8. On the main surface inside the lower substrate 8, a plurality of anode electrodes 9A and cathode electrodes 9K, which compose a plasma electrode and extend in the column direction, are formed in parallel in the row direction alternately with predetermined intervals being held. Substantially at the center on the upper surface of the anode electrode 9A and the cathode electrode 9K, barrier ribs 10 having a predetermined width is formed so as to extend along each electrode. The top of the barrier rib 10 abuts on the lower surface of the dielectric sheet 3, so that the size of the gap between the lower substrate 8 and the dielectric sheet 3 are kept constant.

At the periphery of the lower substrate 8, frit seal materials 11 using low melting point glass or the like are disposed along the periphery of the lower substrate 8, so that the lower substrate 8 is bonded to the dielectric sheet 3 in an airtight manner. The gap between the lower substrate 8 and the dielectric sheet 3 is filled with an ionizable gas. As the filling gas, for example, helium, neon, argon, or the mixture of these gases is used.

Figure 5:
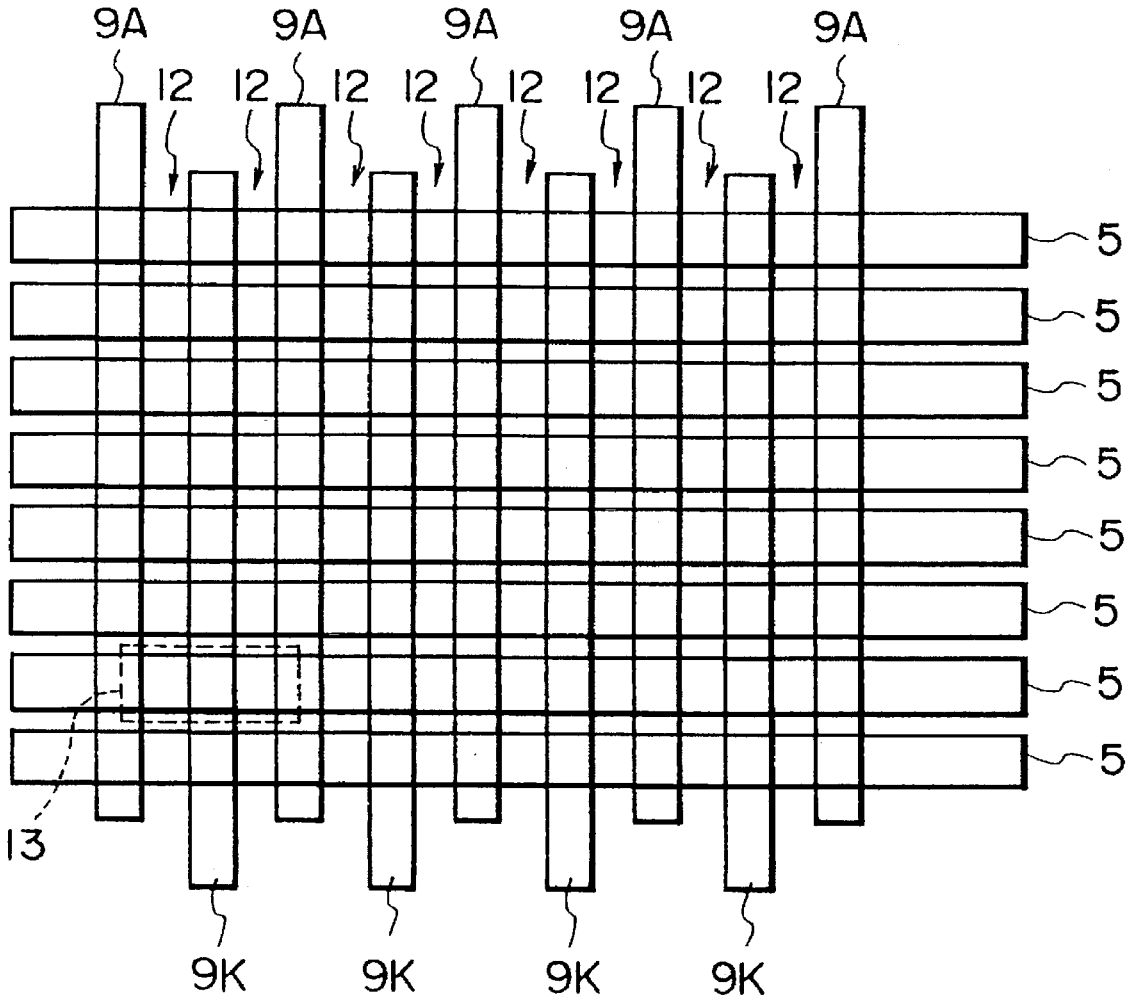
FIG. 5 is a view showing the arrangement of data electrodes, plasma electrodes, and discharge channels.
Figure 6:
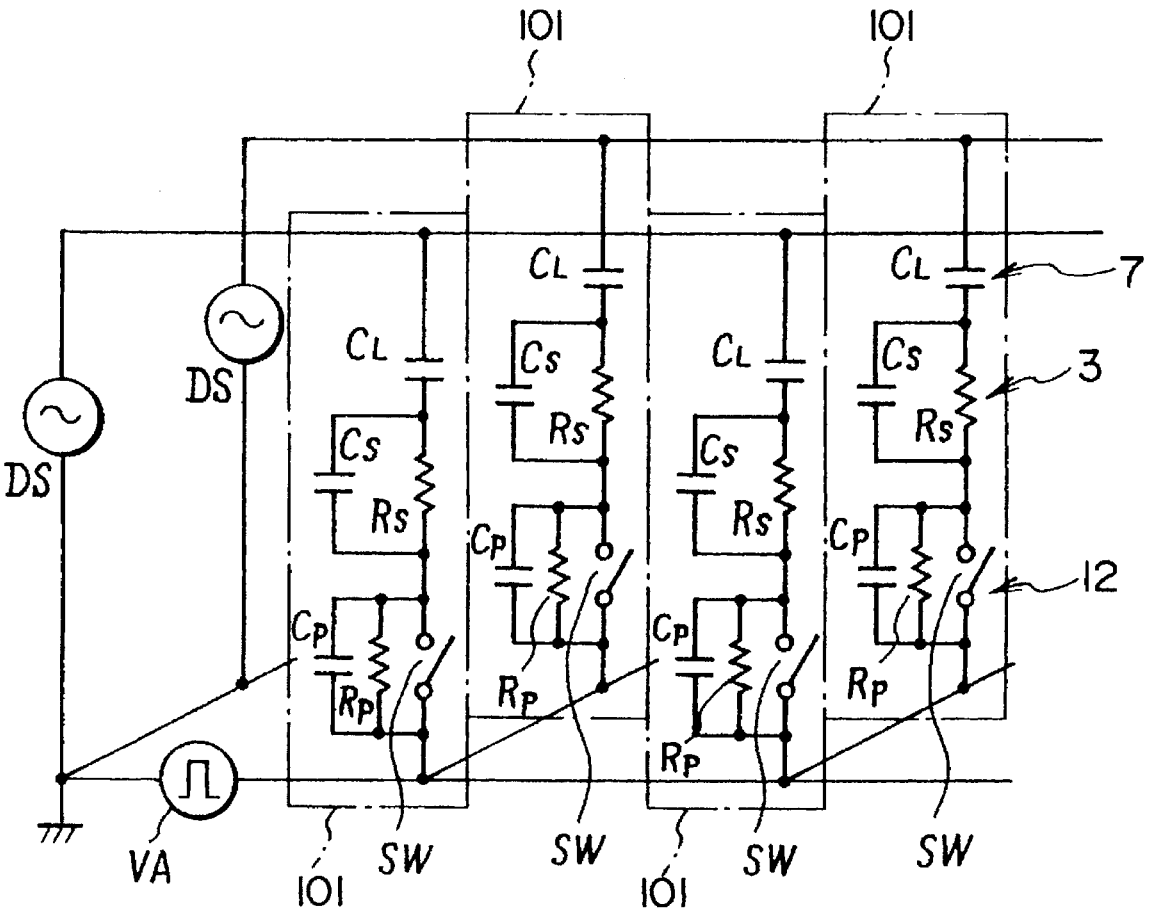
FIG. 6 is a view showing a circuit equivalent to a plasma address display device.
Figures 7A, 7B, 7C, 7D:
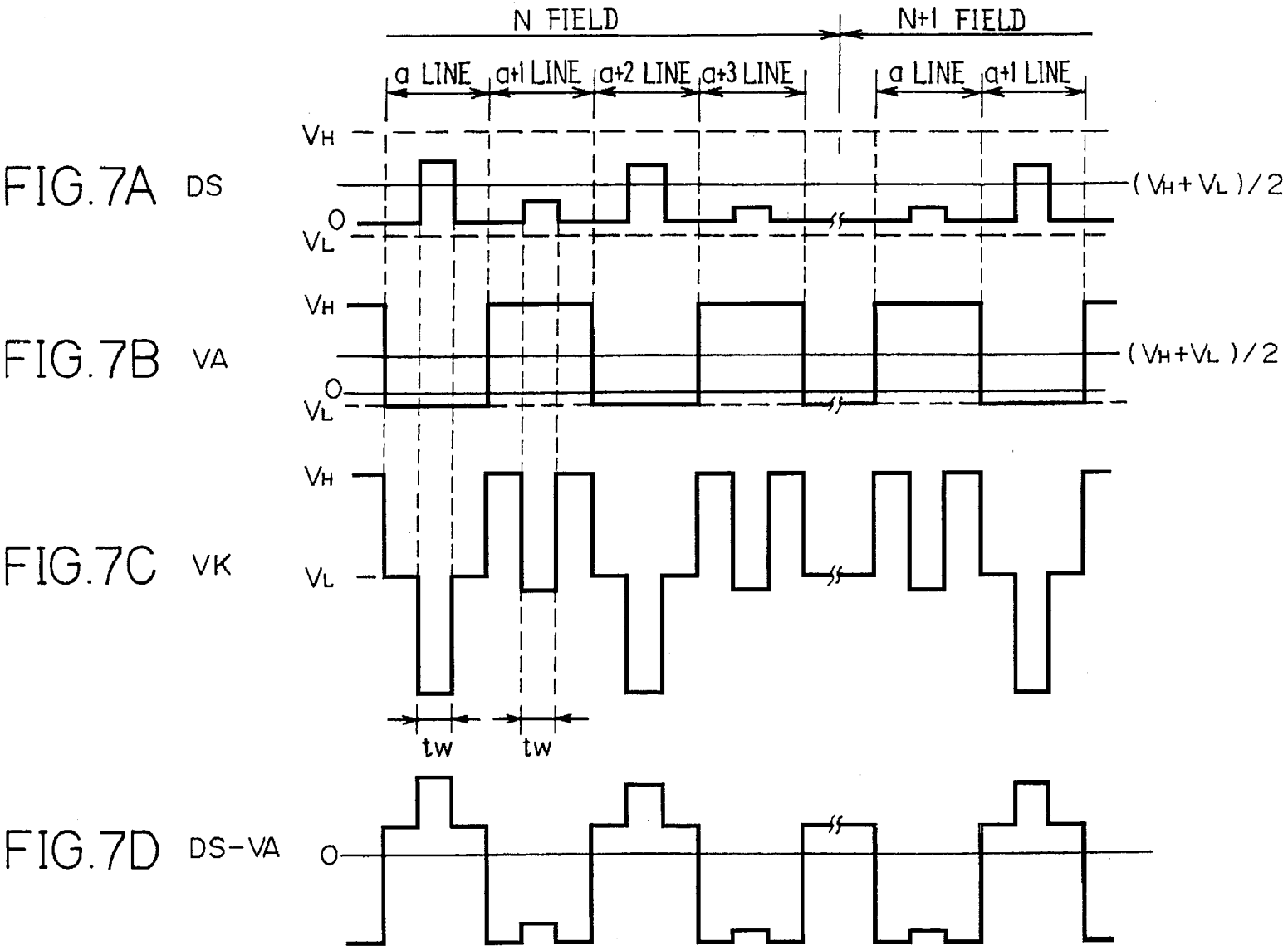
FIGS. 7A, 7B, 7C and 7D are diagrams showing data voltage, anode voltage, cathode voltage, etc.

In the gap between the lower substrate 8 and the dielectric sheet 3, a plurality of discharge channels 12, which are separated by the barrier ribs 10 and extend in the column direction, are formed in parallel in the row direction. That is to say, the discharge channels 12 are formed at right angles to the data electrodes 5. Each data electrode 5 is a column drive unit. Since each anode electrode 9A is connected commonly to supply anode voltage as described later, a pair of discharge channels 12 lying at both sides of each cathode electrode 9K is a row drive unit. At the intersection of the data electrode 5 and the discharge channels 12, a picture element 13 is defined as shown in FIG. 5. The barrier ribs 10 may be formed on the anode electrodes 9A only. If another means is used to keep the size of the gap of the plasma cell constant, the barrier ribs 10 need not be formed.

In the above configuration, when a predetermined voltage is applied between the anode electrode 9A and the cathode electrode 9K, which correspond to a predetermined pair of discharge channel 12, the gas at a part of the paired discharge channels 12 is ionized selectively, producing plasma discharge, and the inside of the discharge channel 12 is kept substantially at the anode potential. In this state, when the data voltage is applied to the data electrode 5, the data voltage is written, via the dielectric sheet 3, on the liquid crystal layer 7 of a plurality of picture elements 13 arranged in the column direction corresponding to the paired discharge channels 12. After the plasma discharge is completed, the discharge channel 12 has a floating potential, so that the data voltage written on the liquid crystal layer 7 of each picture element is held until the next writing period (for example, after one field, or after one frame). In this case, the discharge channel 12 functions as a sampling switch, and the liquid crystal layer 7 of each picture element 13 functions as a sampling capacitor.

Since the liquid crystal is operated by the data voltage written in the liquid crystal layer 7 of each picture element 13, the display is performed in the unit of picture element. Therefore, two-dimensional images can be displayed by producing plasma discharge as described above and sequentially scanning the paired discharge channels 12, which write the data voltage on the liquid crystal layer 7 of the plural picture elements 13 arranged in the column direction, in the row direction.

Figure 1:
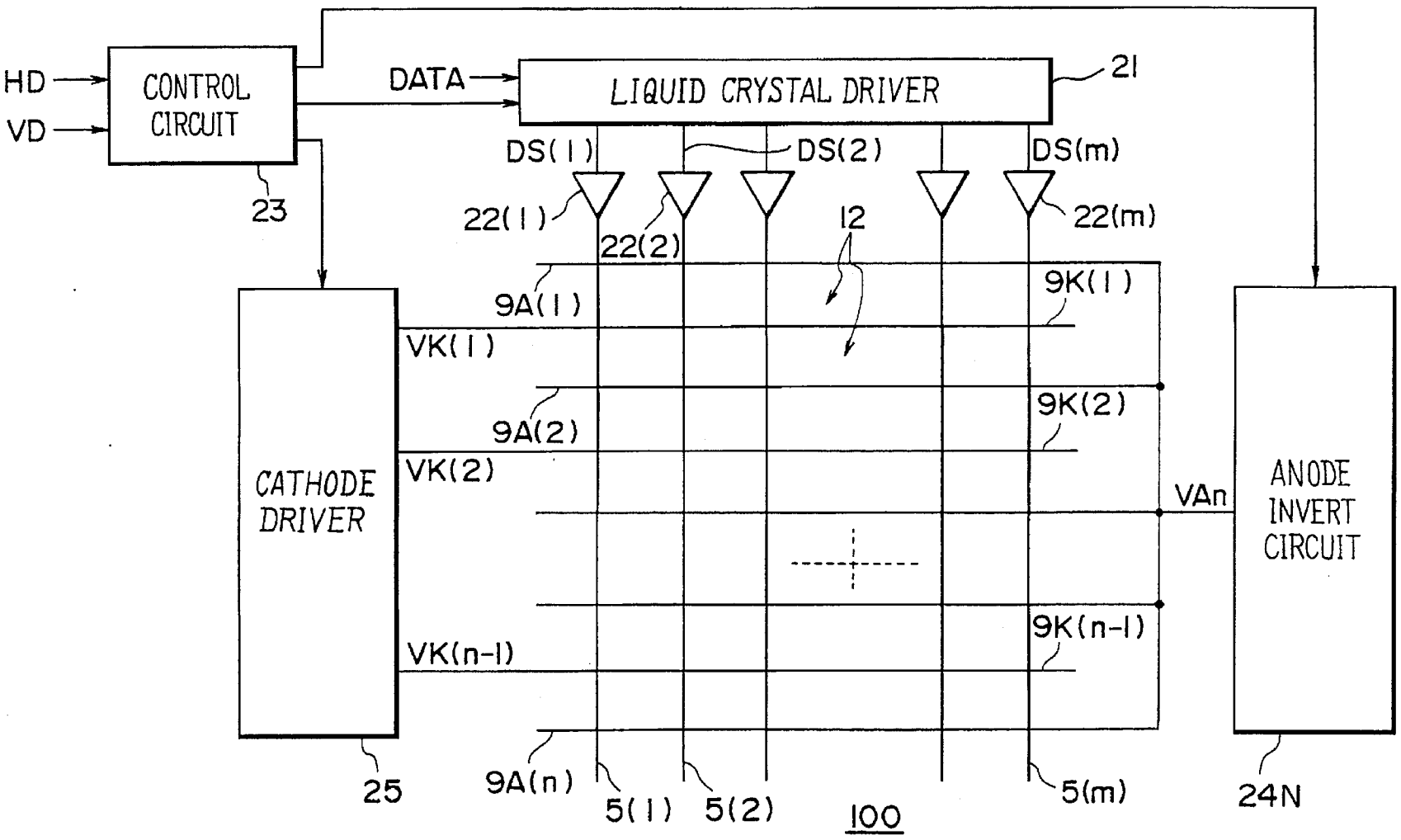
FIG. 1 is a schematic view of circuit showing one embodiment of an electro-optical display device in accordance with the present invention.

FIG. 1 shows the whole configuration of the circuit for the aforementioned plasma address display device 100.

Referring to FIG. 1, video data DATA is supplied to a liquid crystal driver 21. From the liquid crystal driver 21, the data voltages DS(1)–DS(m) for the plural picture elements composing each line for each horizontal period are outputted simultaneously, and the data voltages DS for the plural picture elements are supplied to a plurality of data elements 5(1)–5(m) via buffers 22(1)–22(m), respectively.

The operation of the liquid crystal driver 21 is controlled by a control circuit 23. To the control circuit 23, a horizontal synchronous signal HD and a vertical synchronous signal VD corresponding to the video data DATA are supplied as a synchronous reference signal. The control circuit 23 also controls the operations of an anode invert circuit 24 and a cathode driver 25, described later.

Reference numeral 24N denotes the anode invert circuit. By this anode driver 24N, anode voltage VAn as the reference voltage is supplied to a plurality of anode electrodes 9A(1)–9A(n) connected in common. Reference numeral 25 denotes the cathode driver. By the cathode driver 25, cathode voltages VK(1)–VK(n−1) are supplied sequentially to a plurality of cathode electrodes 9K(1)–9K(n−1). Thereby, plasma discharge takes place sequentially in the paired discharge channels 12 corresponding to the cathode electrodes 9K(1)– 9K(n−1) for each horizontal period. Therefore, the paired discharge channels 12, which write the data voltage DS(1)–DS(m) on the liquid crystal layer 7 of the plural picture elements 13 arranged in the column direction (horizontal direction), are scanned sequentially in the row direction (vertical direction).

Figures 2A, 2B, 2C, 2D:
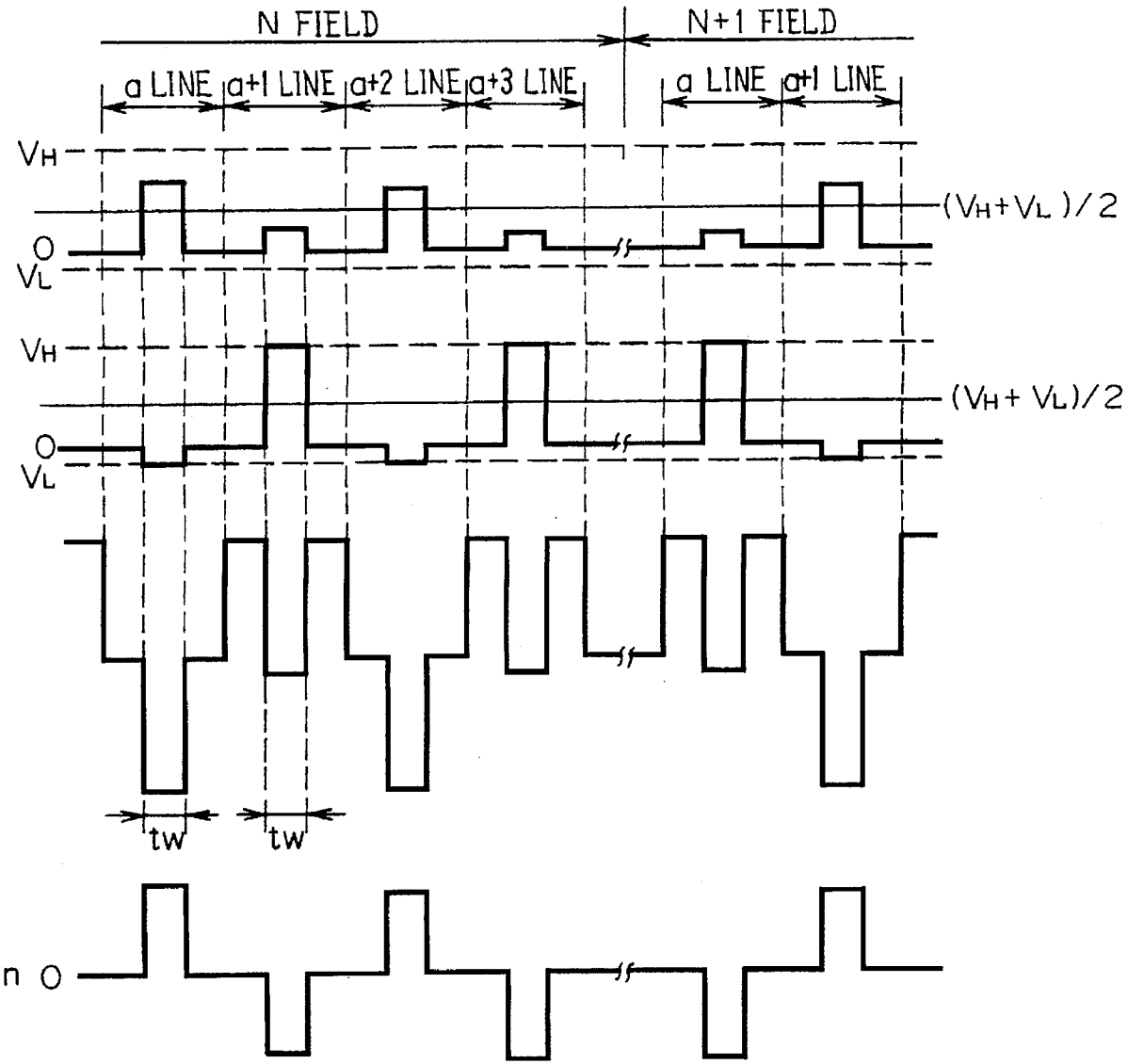
FIGS. 2A, 2B, 2C and 2D are diagrams showing data voltage, anode voltage, cathode voltage, etc. in one embodiment.

FIGS. 2A–2D shows the relationship between the data voltage DS (DS(1)–DS(m)), the anode voltage VAn, the cathode voltage VK (VK(1)–VK(n–1)), and the like. As shown in FIG. 2A, the data voltage DS is supplied from the liquid crystal driver 21 to the data electrodes 5 (5(1)–5(m)) for the writing period tw of each line, and the data electrode 5 is at zero level for other periods. The data voltage DS is outputted from the liquid crystal driver 21 by being inverted for one line and for one field with (VH+VL)/2 being the center. Here, VH denotes positive dc voltage, and VL denotes negative dc voltage.

The anode voltage VAn supplied from the anode invert circuit 24N to the anode electrodes 9A (9A(1)–9A(n)) is outputted by being inverted for each one line and for each one field with (VH+VL)/2 being the center as shown in FIG. 2B. The anode voltage VAn outputted from the anode invert circuit 24N is VH or VL for the writing period tw only, and coincides with the data voltage DS for other periods, being 0 in this embodiment. The anode voltage VAn need not coincide with the data voltage DS completely, but may coincide approximately with it. Thereupon, since the data voltage DS and the anode voltage VA are alternately inverted for each one line and for each one field, the liquid crystal layer 7 is ac driven.

The cathode voltage VK outputted from the cathode driver 25 is, as shown in FIG. 2C, adapted to have a predetermined voltage difference between the cathode voltage VK and the anode voltage VA for the writing period tw of each line so that plasma discharge takes place between the cathode electrode 9K and the anode electrode 9A, and have the same voltage value as that of the anode voltage VA for other periods.

In this embodiment, the voltage difference between the data voltage DS and the anode voltage VAn, and in turn the voltage applied to the series circuit of the liquid crystal layer 7, the dielectric sheet 3, and the virtual switch SW changes as shown in FIG. 2D, so that the voltage is zero for the periods other than the writing period tw. Thus, for the writing period tw, since the data voltage DS and the anode voltage VAn are inverted alternately for each one line and for each one field, the liquid crystal layer 7 is ac driven. For the periods other than the writing period tw, since the data voltage DS coincides with the anode voltage VAn and the voltage difference is zero, no unnecessary voltage is applied to the liquid crystal layer 7 for the periods other than the writing period tw. Therefore, the dc component can be prevented from being applied to the liquid crystal layer 7, so that the deterioration in liquid crystal such as image retention is restricted, by which the long-term reliability can be enhanced.

For the periods other than the writing period tw, since the data voltage DS coincides with the anode voltage VAn and the voltage difference is zero, the effective value of the drive signal (voltage difference between the data voltage DS and the anode voltage VAn) of each line becomes low, so that the generation of crosstalk caused by the drive signal of another line can be restricted.

In the above embodiment, an example in which the electro-optical display cell 1 has a liquid crystal layer 7 has been shown. However, the present invention can also be applied similarly to an electro-optical display device in which the display cell 1 has another electro-optical material layer in which the deterioration in display characteristics such as image retention is produced by the application of dc component.

Also, in the above embodiment, the plasma cell 2 is applied to the plasma address display device 100 functioning as the switching element SW (sampling switch). However, the present invention can be applied to a TFT liquid crystal display device or the like, in which a thin film transistor is used as the switching element SW. In this case, for the periods other than the writing period for which a gate signal is supplied to a gate electrode, the display device may be configured such that the signal electrode voltage (data voltage) coincides approximately with the common electrode voltage (reference voltage).

Further, in the above embodiment, an example has been shown in which a plurality of anode electrodes 9A(1)–9A(n) are connected in common so that the anode voltage VAn is supplied, and a pair of discharge channels 12 perform as a row drive unit. Alternatively, the present invention can be applied similarly to a device in which, the anode voltage VAn is supplied independently to each of, for example, a plurality of anode electrodes 9A(1) to 9A(n), and each of the discharge channels 12 performs as a row drive unit, or a device in which the method for driving the anode electrodes 9A(1) to 9A(n) is different.

What is claimed is:

1. An electro-optical display device comprising:

a plurality of picture elements arranged in a matrix form each of said picture elements being composed of an electro-optical material layer and a switching element which is electrically connected to said material layer in series;

means for providing a data voltage on said electro-optical material layer via said switching element for a writing period;

means for applying a reference voltage to the other end of a connection to which said data voltage is applied, said reference voltage being inverted alternately together with said data voltage for each predetermined period, by which said electro-optical material layer is ac driven; and control means for making the value of said data voltage coincide approximately with that of said reference voltage for the periods other than the writing period.

2. An electro-optical display device according to claim 1, wherein said switching element is a plasma switch.

3. An electro-optical display device according to claim 1, wherein said switching element is a thin film transistor.

4. An electro-optical display device according to claim 1, wherein said electro-optical material layer is a liquid crystal layer.

5. An electro-optical display device according to claim 2, wherein said plasma switch is plasma produced between an anode electrode and a cathode electrode.

6. An electro-optical display device according to claim 5, wherein said reference voltage is a voltage applied to the anode electrode.

7. A method for driving a display device comprising a display cell having data electrodes arranged in parallel with each other and a plasma cell producing discharge channels formed at right angles to said data electrodes, in which the data voltage applied to said data electrodes is inverted alternately together with a predetermined reference voltage, and the value of said data voltage coincides substantially with that of said reference voltage for the periods other than the period for writing said data voltage.

8. A method for driving a display device according to claim 7, wherein said discharge channel is formed by the discharge of ionizable gas between an anode electrode and a cathode electrode.

9. A method for driving a display device according to claim 8, wherein said reference voltage is a voltage applied to said anode electrode.

* * * * *